United States Patent [19]

Moe et al.

[11] 4,237,648

[45] Dec. 9, 1980

[54] MOVING TOY FIGURE

[75] Inventors: Walter Moe, Los Angeles, Calif.; Charles M. Diker, New York, N.Y.

[73] Assignee: Diker Moe Associates, West Los Angeles, Calif.

[21] Appl. No.: 5,989

[22] Filed: Jan. 24, 1979

[51] Int. Cl.[3] ..... A63H 11/00; A63F 9/14

[52] U.S. Cl. ..... 46/122; 46/149; 46/216; 104/172 B; 273/86 F

[58] Field of Search ..... 46/236–242, 46/216, 122, 149; 273/86 F

[56] References Cited

U.S. PATENT DOCUMENTS

| | | | |
|---|---|---|---|
| 3,473,805 | 10/1969 | Biller | 273/86 F |
| 3,552,322 | 9/1968 | Clowes | 273/86 F X |
| 3,672,674 | 6/1972 | Reed | 46/240 X |
| 3,699,711 | 10/1972 | Coffey | 46/216 |
| 3,948,520 | 4/1976 | Barlow | 273/86 F |

FOREIGN PATENT DOCUMENTS

| | | | |
|---|---|---|---|
| 2204772 | 8/1973 | Fed. Rep. of Germany | 46/241 |
| 1229648 | 3/1960 | France | 273/86 F |

*Primary Examiner*—F. Barry Shay

[57] ABSTRACT

A toy including a central board with at least one recessed track in the upper surface thereof. The recessed track has an endless belt which in a preferred embodiment may be a thin strip of nylon with teeth extending upwardly therefrom. The strip may be moved in the preferred embodiment by a sprocket acting on holes along the length of the strip. A figure has downwardly-depending prongs which mate with the teeth on the nylon belt so that the figure may be propelled by the movement of the belt. The prongs may be such that they will assume a retracted position within the figure when the figure is placed on a planar surface. The belt may be low friction material (e.g. nylon) and the board may be surfaced with low friction material. The figure may have pivoted legs which brush the board surface causing the legs to swing and simulate a walking motion, and a vehicle may be provided through which the figure projects to contact the belt. Two tracks with separate drive means and controls may be provided on the board to permit racing games.

2 Claims, 8 Drawing Figures

MOVING TOY FIGURE

BACKGROUND OF THE INVENTION

The background of the invention will be discussed in two parts:

1. Field of the Invention

This invention relates to children's toys and, more particularly, to a child's toy which includes a board with a movable track adapted to propel figures and vehicles from place to place.

2. Description of the Prior Art

There have been many prior art toys which include figures and vehicles which are moved from place to place in order to entertain children. In general, such figures and vehicles are firmly fixed to the play area and are not useful except therewith. Consequently, such prior art devices include a relatively limited number of figures and vehicles; and, in a short period of time, children become bored with the toy and discard it.

It is an object of the present invention to provide a new and improved child's toy including a central track portion for moving figures and vehicles.

Another object of the present invention is to provide a child's toy having figures and vehicles which may be moved from place to place and may be removed from the toy and used individually.

It is still another object of the present invention to provide a new and improved child's toy which includes a device capable of moving varied objects from place to place.

SUMMARY OF THE INVENTION

The foregoing and other objects of the invention are accomplished by a child's toy which includes a central board with an endless loop track and a number of toy figures, vehicles, and the like which are adapted to cooperate with the track to be moved from place to place. In a preferred embodiment, the track is made of a strip of thin nylon material having sprocket holes cut therein and a series of teeth projecting upwardly normal to the length of the nylon strip. The board is provided with a driving mechanism which revolves a sprocket for moving the strip in a recessed groove in the board. The figures and vehicles are provided with downwardly extendable members adapted to engage the teeth of the nylon strip.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
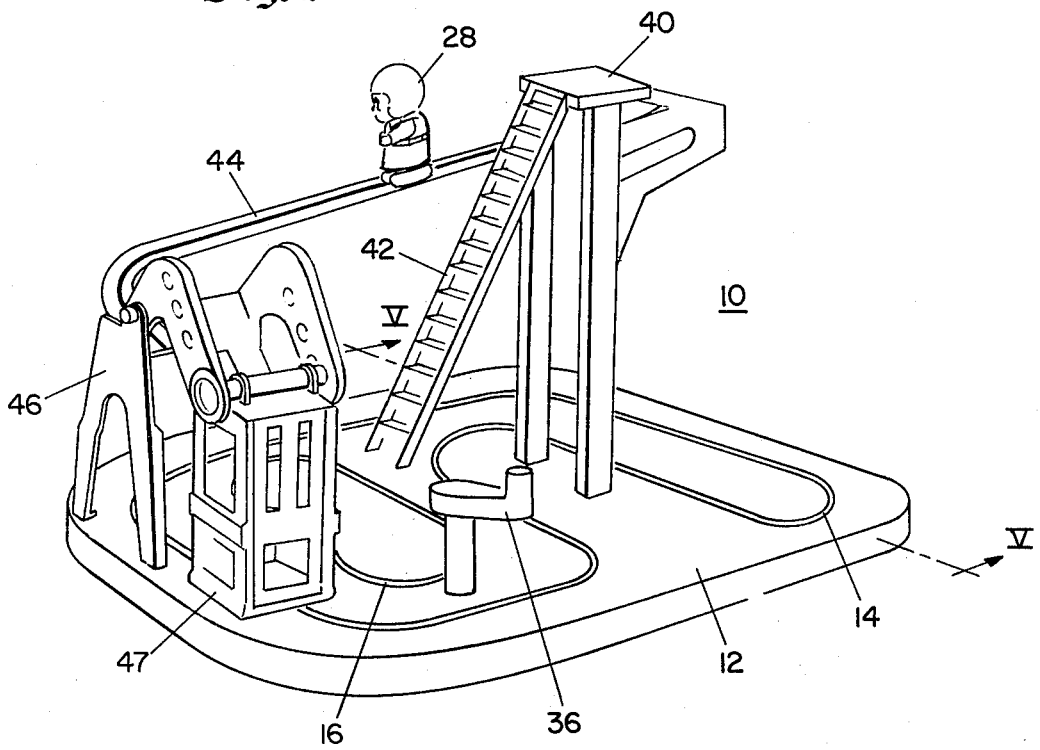
FIG. 1 is a perspective view of a toy constructed in accordance with the invention.
Figure 5:
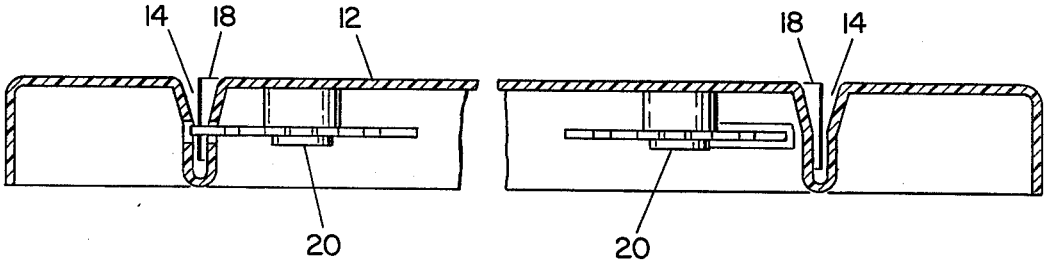
FIG. 5 is a cross-sectional side view of the base of the toy shown in FIGS. 1 and 2 taken along the line VV shown in FIG. 2.

Referring now to the drawings and, more particularly, to FIG. 1, there is shown in perspective view a toy 10 constructed in accordance with the invention. The toy 10 includes a central base portion 12 containing a first track 14 and a second track 16. The tracks 14 and 16 are both of the endless loop variety. Each track 14 and 16, as may be seen in the cross-section view in FIG. 5, comprises a trough or groove which depends from the upper surface of the base 12 and has positioned therein a nylon strip 18. The nylon strip 18 is driven and held in position by a series of control wheels 20 and a drive wheel 24. The drive wheels 24 and control wheels 20 support the strip 18 above the bottom surface of the track 14 as shown in FIG. 5, and also act to retain the strip 18 in the track 14 so that it will not shift up and out of the track 14.

Figure 2:
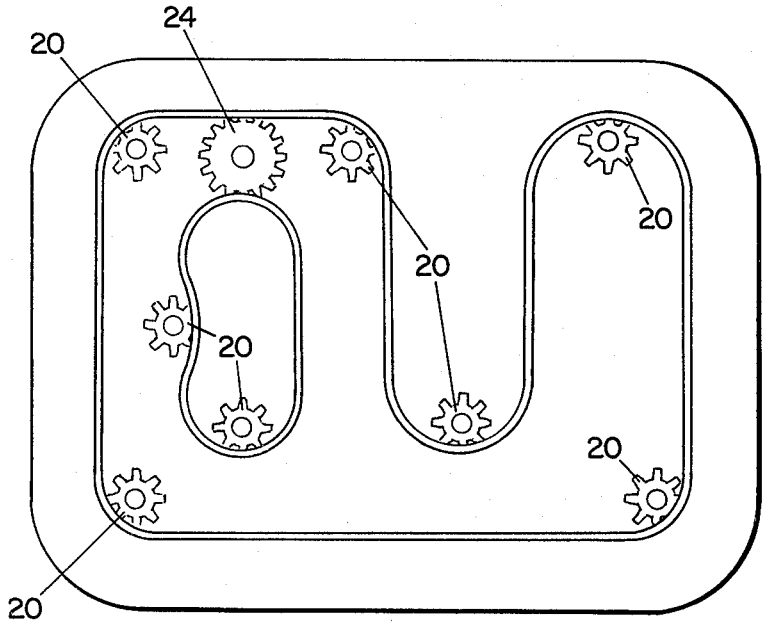
FIG. 2 is a bottom view of the toy shown in FIG. 1.
Figure 3:
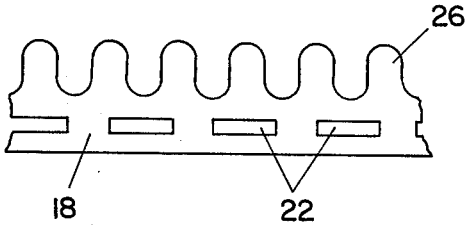
FIG. 3 is a view of a portion of the nylon strip used in the toy shown in FIGS. 1 and 2.
Figure 4:
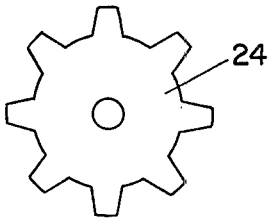
FIG. 4 is an enlarged view of one of the control and driving wheels used in the toy shown in FIG. 1.

The nylon strip 18 is better shown in FIG. 3 which shows a shortened section thereof. The nylon strip 18 has a number of sprocket holes 22 positioned evenly therealong which may be driven by the teeth of a sprocket such as drive sprocket 24 shown enlarged in FIG. 4. The sprocket 24 is simply a larger version of the wheels 20 shown in FIGS. 2 and 5 which assist in maintaining the nylon strip 18 at the correct height in the grooves of the tracks 14 and 16. The nylon strip 18 shown in FIG. 3 also has a number of upwardly extending teeth or fingers 26 which are adapted to engage a toy figure, vehicle, or the like which may be positioned on the base portion 12 above either of the tracks 14 or 16.

Figure 6:
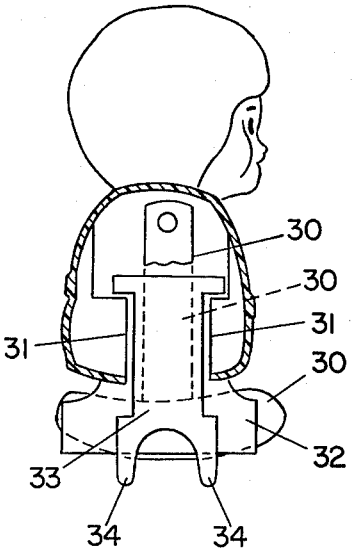
FIG. 6 is an enlarged, partially cut-away side view of a figure which may be used in the toy shown in FIG. 1.
Figure 7:
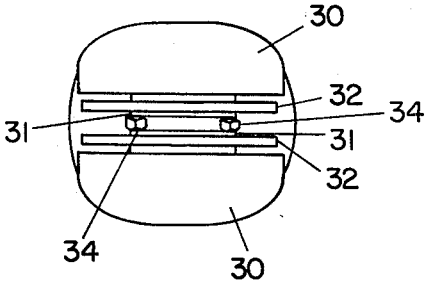
FIG. 7 is a bottom view of the figure shown in FIG. 6.

A particular toy figure 28 shown in FIG. 1, may be used on the tracks 14 and 16. Such a figure is shown in enlarged form in FIG. 6. The figure 28 includes a pair of legs 30 each rotatably mounted at its upper end and having a foot on the bottom thereof. A two-sided, central, downwardly-extending projection 32 forms a channel with constraining walls 31. Slidably mounted between the two sides of the projection 32 and the walls 31 is a piece 33 which carries a pair of depending prongs 34 adapted to drop into position to mesh with the fingers 26 of the nylon strip 18. When a figure 28 is positioned in such a manner on the strip 18, a handle 36 mounted on the base portion 12, may be rotated thereby causing the sprocket 24 to move the nylon strip 18 about each of the tracks 14 and 16 and move the figure 28.

The figure 28 is so designed that when one of the legs 30 contacts the surface of the base 12 and moves to the rear, the toe of that foot raises the figure 28 slightly thereby shifting the balance to the opposite foot. As this opposite foot contacts the surface of the base 12, it begins to move to the rear of the figure 28 while the other foot swings forward. Thus, the figure 28 moves around the surface of base 12 in a simulation of walking.

Also shown positioned on the base portion 12 are a platform 40 having a ladder 42 leading thereto from the lower level of the base portion 12 and a third track 44 inclined downwardly from the platform 40. The track 44, unlike the tracks, 14 and 16, has no nylon strip which will cause figures positioned thereon to move along its length. However, the track 44 is so inclined and the figures (such as the figure 28 shown in FIG. 1) are so devised that a particular figure 28 placed upon the track 44 will be caused to progress downwardly therealong to the left end of the track 44 shown in FIG. 1 by force of gravity. The particular figure 28 (shown in FIG. 6) has its two legs 30 pivoted at the upper ends thereof so that they move forwardly and backwardly as the figure 28 progresses along the track in a swaying walking motion. The downwardly depending projections 34 jut through the open center of the track 44 to maintain the figure 28 in position as it walks.

In the particular embodiment shown in FIG. 1, a second platform 46 is provided at the left end of the track 44. The platform 46 has a swing-away portion 47 which is adapted to permit the user of the toy to lower the figure 28 downwardly into position so that the figure 28 may be moved about the track 14 without any great hesitation. This enables various figure toys to be used to play games exciting to small children. For example, a figure 28 may be placed on the track 44 at the right hand edge and caused to move downwardly therealong. A vehicle may be placed behind it so that it appears to chase the figure 28 along the track. The figure 28 escapes by climbing into the swing-away portion 47 of the second platform 46 and being lowered to the level of the track 14. As seen in FIG. 1, the portion 47 is pivoted at its top to an arm which is pivoted to the top of the platform 46 so that the portion 47 swings between the upper and lower levels. Obviously, rotation of the handle 36 will cause the figure 28 to move about the track 14. Other games may be devised using vehicles, figures, and the like on the tracks 14, 16 and 44.

All of the elements of the toy 10 shown in FIG. 1 may be constructed of molded plastic or other materials adapted to provide ease of manufacture at a relatively low expense. As explained, the nylon strip 18 is positioned in each of the tracks 14 and 16 at an appropriate height determined by the sprocket 24 and the wheels 20.

Various prior art devices have used various materials to form driving mechanisms for propelling objects around a track. Many such devices tend to stick in the track. It has been discovered in practice that a nylon strip like that shown in FIG. 3 may be easily moved about the recesses of the tracks 14 and 16 without being jammed against the sides if in manufacture the particular strip 18 is placed in position so that it overlaps at its two ends, pulled as tightly as possible in the track, and this first position marked. The two ends of the strip 18 are then pushed as far apart as possible while the strip 18 remains in the track, and a second overlapping position is determined. If a mid-point between these two positions is selected for joining the two ends of each strip 18 together, the strip 18 will (when joined) move freely in tracks 14 and 16 without binding.

It will be realized that each of the figures 28 and the like which may be positioned on the track by the unique arrangement shown in this invention may be removed therefrom and used to play in other situations apart from the board 12. When a figure is removed from the track, the piece 33 may be pushed upwardly into the body of the figure so that the prongs 34 no longer project therefrom. Consequently, any number of particular figures, vehicles, and the like may be used to provide additional variety and excitement for the invention.

Figure 8:
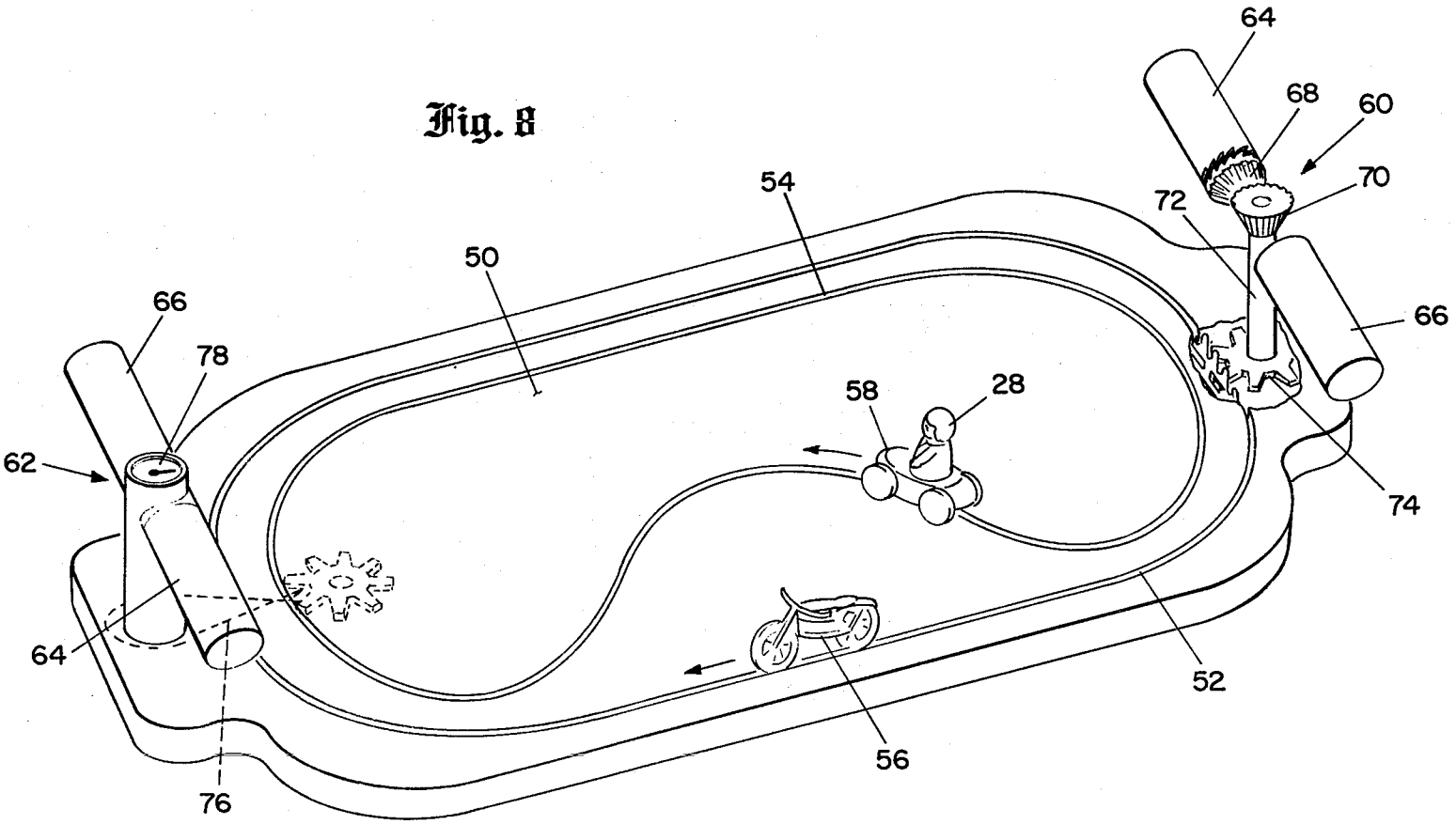
FIG. 8 is a perspective view of another embodiment of the invention.

Referring now to FIG. 8, there is shown in perspective view another embodiment of the invention including a central base portion 50 having positioned thereon two tracks 52 and 54 (similar to the tracks 14 and 16 described above and each including a strip 18 for moving figures placed thereon). Positioned on the track 52 is a motorcycle 56; a vehicle 58 having therein a figure toy 28 is positioned on the track 54. The figure toy 28 is positioned to mesh with the fingers 26 of the strip 18 and fits through a hole completely through the vehicle 58 so that movement of the figure toy 28 will impel the vehicle 58 about the track 54.

The two tracks 52 and 54 are selected to be of equal lengths, and each is driven separately by mechanisms 60 and 62, respectively. Consequently, the toys on the two tracks 52 and 54 may be made to race against one another lending excitement to the toy. The mechanisms 60 and 62 are similar although mechanism 60 is shown with its exterior casing removed to illustrate its operation. The mechanism 60 includes a drive handle 64 and an idler handle 66 each of which may be rotated. The drive handle 64 has gearing on one end which matches that on a bevel gear 68. When rotated in one direction the handle 64 drives the bevel gear 68 to rotate a second bevel gear 70. In the opposite direction of rotation, the end surface of the handle 64 merely slips against the bevel gear 68. The bevel gear 70 drives a shaft 72 which rotates a track drive sprocket 74 causing the strip 18 in the track 52 to move.

The mechanism 64 functions in a like manner to move the strip 18 of the track 54. An additional linkage including a belt drive 76 may be utilized to drive the strip 18 of the inner track 54.

The mechanisms 60 and 62 are shaped like motorcycle handlebars and, consequently, lend authenticity to a racing game played by children. Additional authenticity may be added by including a speedometer 78 linked to the mechanism 62 to indicate a speed of the vehicle on the associated track.

While there has been shown and described a preferred embodiment, it is to be understood that various other adaptations and modifications may be made within the spirit and scope of the invention.

What is claimed is:

1. A toy comprising a baseboard having an upper surface with a groove therein, an endless belt with upwardly-extending projections which belt fits into the groove, means for moving the belt longitudinally in the groove and supporting the belt above the bottom surface of the groove and restraining the belt from shifting up and out of the groove, and a figure adapted to mesh with the projections of the belt, the figure including a bottom portion adapted to support the figure in upright position on a planar surface, downwardly-depending projections, and means mounting the projections whereby they will extend beyond the bottom portion when the figure is placed upright on the board over the groove, and will be caused to retract into the figure when it is placed upright on a planar surface.

2. A toy as claimed in claim 1 further comprising an inclined track mounted above the upper surface, and means in the figure for contacting with means associated with the inclined track for causing the figure to move down the inclined track by force of gravity.

* * * * *